United States Patent [19]

Hallet et al.

[11] Patent Number: 4,610,548

[45] Date of Patent: Sep. 9, 1986

[54] HOMOGENIZER

[75] Inventors: Peter Hallet, Bergisch-Gladbach; Erwin Hess, Hückelhoven-Baal; Hans-Jürgen Mertens, Grevenbroich, all of Fed. Rep. of Germany

[73] Assignee: Fried. Krupp Gesellschaft mit beschränkter Haftung, Essen, Fed. Rep. of Germany

[21] Appl. No.: 673,046

[22] Filed: Nov. 19, 1984

[30] Foreign Application Priority Data

Nov. 23, 1983 [DE] Fed. Rep. of Germany ..... 3342304

[51] Int. Cl.[4] ..... B01F 5/12

[52] U.S. Cl. ..... 366/279; 366/176; 366/304; 366/306; 366/317

[58] Field of Search ..... 366/262, 263, 265, 279, 366/290, 291, 302, 303, 305, 306, 307, 315, 316, 317, 176, 304; 415/143, 199.1, 199.2, 199.3, 206, 209, 210, 211, 219 B; 416/122, 175, 203

[56] References Cited

U.S. PATENT DOCUMENTS

| | | | |
|---|---|---|---|
| 2,708,883 | 5/1955 | Keller | 415/199.3 |
| 3,684,396 | 8/1972 | Ball | 415/206 |
| 3,788,764 | 1/1974 | Shuey | 415/199.3 |
| 3,995,838 | 12/1976 | Zucker | 366/304 |
| 4,431,482 | 2/1984 | Heinbockel | 366/304 |

FOREIGN PATENT DOCUMENTS

| | | | |
|---|---|---|---|
| 257121 | 8/1926 | United Kingdom | 415/206 |

*Primary Examiner*—Robert W. Jenkins
*Attorney, Agent, or Firm*—Becker & Becker, Inc.

[57] ABSTRACT

A homogenizer, with which the homogenization power is minimized while maintaining good homogenization, and with which at the same time the conveying power of the homogenizer is increased. This is achieved via a constant free cross-sectional area within the individual homogenizing stages, and by a hydrodynamically favorable design of the free space which surrounds the tools of the homogenizer. Baffle elements or a subsequently connected second pump stage can be provided.

6 Claims, 8 Drawing Figures

HOMOGENIZER

BACKGROUND OF THE INVENTION

1. Field of the Invention

The present invention relates to an apparatus for producing emulsions or suspensions, and comprises a rotary homogenizer which includes a housing in which there is disposed a rotating rotor. The end face of which is provided with collars having apertures; the collars of the rotor rotate between collars which are similarly disposed on the housing. The axial inlet, while leaving a gap, opens centrally against the end face of the rotor, and the outlet is radially disposed.

2. Description of the Prior Art

Rotary homogenizers of the aforementioned general type are known, as disclosed, for example, in German Auslegeschrift No. 11 82 043. The rotors and stators are provided with slot-shaped or circular openings, rotate concentrically, within one another, and have an excellent mixing and homogenizing effect due to the opening ratios of the concentric rings and due to the small distance between the rotor and the stator. Due to the finite height of the stator and the rotor, the latter also have a slight conveying effect.

With material which is to be mixed and which has, for example, intrinsic viscosity, the drive power of the homogenizer is virtually independent of the viscosity. The degree of intermixing depends exclusively upon the number of openings on the individual collars, as well as on the speed. When the number of openings or teeth is increased, the speed can be reduced without impairing the mixing results. Therefore, by appropriate construction of the collars, the electrical drive power can be minimized.

With the use of the homogenizer, and by means of the defining walls of the openings or by means of the teeth of the collar bodies, sections which were advanced over an adjacent collar are cut off and are brought to another location, where the cut off slice is again mixed with other material. The mixing process can be conceived approximately as follows: the material which is to be mixed is grasped as it leaves each of the openings by the adjacent collar, and is taken along as little slices. Thus, there is constantly effected a cutting off of small pieces of material, with subsequent rearrangement and renewed size reduction of the cut-off pieces. The size reduction and rearranging processes become more intensive as the number of openings on the collars increases. The degree of intermixing depends upon the product, the number of apertures on the individual collars, and the speed.

The homogenizer operates in such a way that only slight inherent conveyance is achieved. Thus, the hydraulic power of the electrical drive power to be installed on such a machine is approximately 5% of total power. The remaining 95% of the electrical work power is homogenization power.

An object of the present invention is to provide an apparatus which, while not altering the good homogenization, minimizes the homogenization power and at the same time increases the conveying power.

BRIEF DESCRIPTION OF THE DRAWINGS

These objects, and other objects and advantages of the present invention, will appear more clearly from the following specification in conjunction with the accompanying drawings, in which.

SUMMARY OF THE INVENTION

Figure 2:
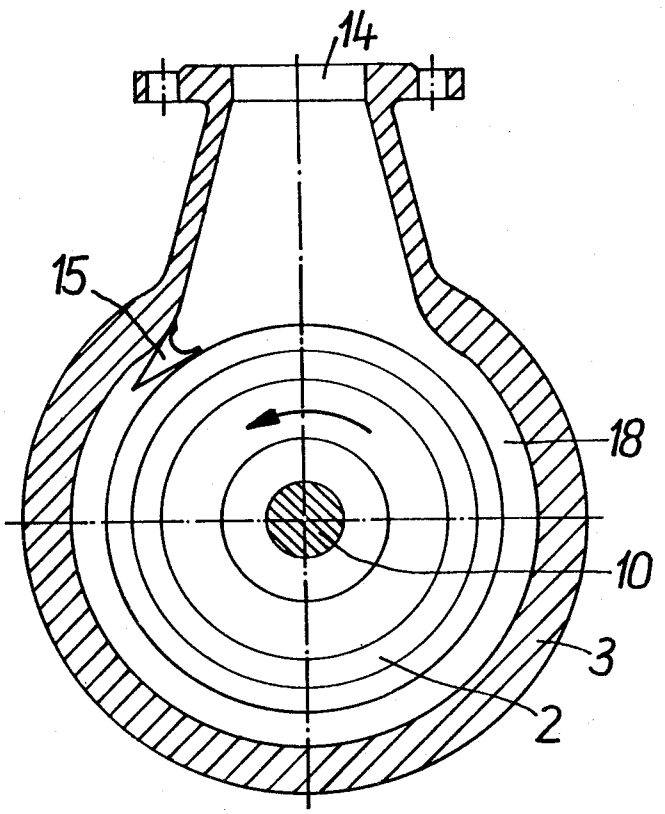
FIG. 2 is a cross-section view taken along the line II—II in FIG. 1.

The apparatus of the present invention is characterized primarily in that the free cross-sectional areas in the collars of the rotor and of the housing, which cross-sectional areas are formed by means of the apertures, are constant from collar to collar; a baffle element can be inserted in the free space which surrounds the collars, and can extend over the entire depth thereof.

Due to the constant free cross-sectional area, the electrical drive power drops. This energy gain is utilized for the hydraulic power, whereby the free space is hydrodynamically optimally taken advantage of by means of the baffle element. Thus, due to the inventive combination, while not changing the electrical power nor the homogenization, the amount the homogenizer can convey is increased.

In order to improve the hydrodynamics of the machine, the baffle element can be in the form of a wedge which, when viewed in the direction of rotation of the rotor, is disposed after the outlet. In place of the wedge, a movable flap also can be provided at the outlet. Depending upon the direction of rotation of the rotor, the flap rests on its own on the appropriate wall of the outlet. In particular, such a baffle element can be constructed as a swinging flap which is disposed within the outlet. The axis of rotation of the flap, which extends parallel to the drive axis of the rotor, is located in the effective range of the rotor and approximately in the middle of the outlet. The manner in which this flap operates is similar to that of the wedge. Furthermore, it has the advantage that the machine can be operated in both directions of rotation without having to be modified. As a further alternative to a wedge, a vaned ring can be provided which comprises a support ring which is rigidly connected with the ring of the rotor, and vanes which are mounted on this support ring.

In many cases, after a homogenizer a certain feed pressure is required at a given through put. In such a case, the objects of the present invention also can be realized by providing in place of the baffle element a second stage, and installing therein a rotary pump rotor. In particular, such an apparatus encompasses two-stage construction of the homogenizer, with the rotary pump rotor being installed on the shaft of the homogenizer in the second stage as viewed from the inlet. A deflection system is connected to the housing between the first and second stages for supplying the emulsion or suspension from the first stage to the second stage. In the region of the rotary pump rotor, the housing is designed in conformity to the requirements of a rotary pump, and is provided with a tangential outlet. With this apparatus also, the energy which is gained is utilized for the hydraulic power.

The deflection system between the first and the second stages assures a satisfactory flow of the emulsion or suspension from one stage to the other. The deflection system can comprise an annular channel which in the region of the homogenizer has a 90° angular profile, and subsequent thereto and to the inlet into the rotary pump rotor has an S-shaped profile.

DESCRIPTION OF PREFERRED EMBODIMENTS

Figure 1:
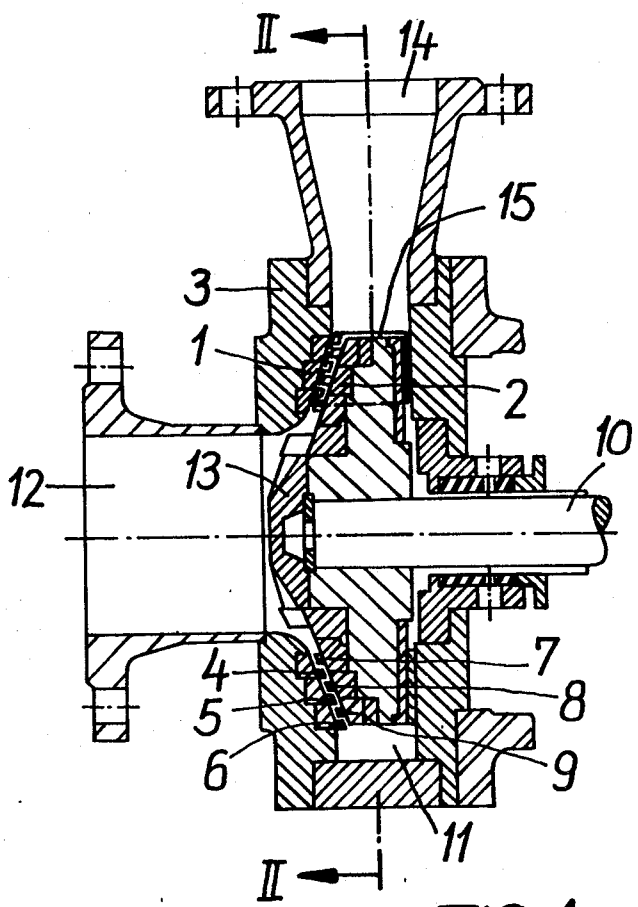
FIG. 1 shows a cross-section view through one embodiment of the inventive homogenizer.
Figure 3:
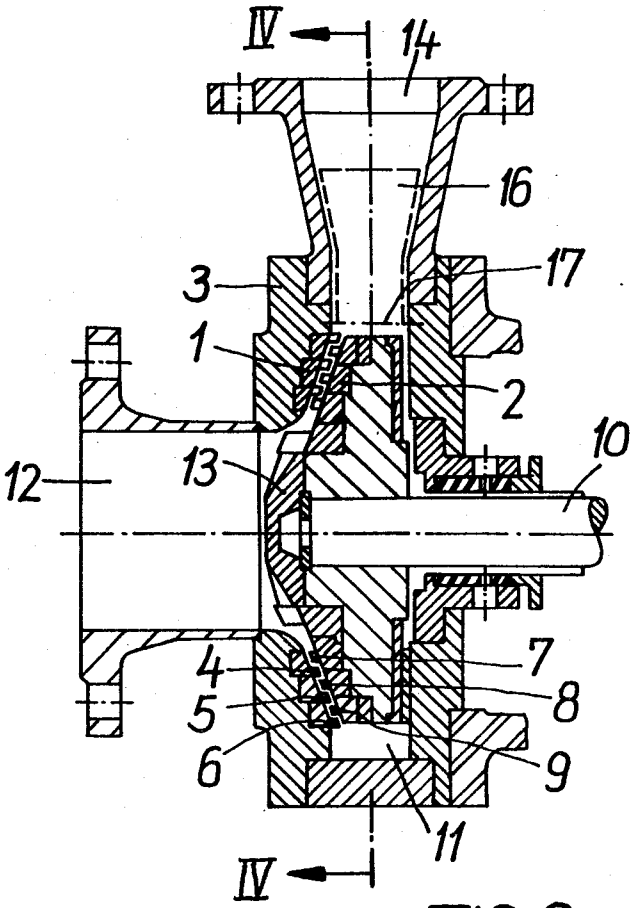
FIG. 3 is a cross-sectional view through a modification of the inventive homogenizer.

Referring now to the drawings in detail, the homogenizer illustrated in FIGS. 1 and 3 in the housing 3 thereof a first ring body 1, which is designated as a stator, and a second ring body 2, which is designated as a rotor. The stator 1 is constructed, for example, as an inner cone, and the rotor 2 is correspondingly constructed as an outer cone, with the conical surfaces facing one another. The stator 1 is provided with a plurality of coaxial collars 4, 5, and 6, which comprise individual teeth which are spaced from one another. Apertures or gaps are disposed between the teeth of a given collar. These gaps form the free cross-sectional area of a given collar.

The collars of the rotor 2 are designated with the reference numerals 7, 8, and 9. Each of these collars also comprises teeth which, while forming apertures or gaps, are spaced from one another. Here, too, the gaps form the free cross-sectional area.

While the first ring body or stator 1 is rigidly disposed in the housing 3, the second ring body or rotor 2 is mounted on a shaft 10 which is driven by a non-illustrated drive motor via transmission gearing. The mounting and sealing of the shaft 10 is visible in FIGS. 1 and 3, and therefore need not be explained in detail. The front end of the shaft 10 supports the second ring body 2, which is located in the mixing chamber 11 in the interior of the housing 3.

The substances which are to be mixed are pushed into the inlet or intake 12, which is disposed directly opposite the front end of the shaft 10, so that the material which is to be mixed is pressed axially against the second ring body 2. The latter can be provided with a guide arrangement 13 which faces the inlet 12 and guides the material which is to be mixed radially outwardly, conveying the material into the region between the intermeshing collars 4 to 9. The material to be mixed moves radially outwardly through and between the collars. Since in each case two adjacent collars rotate relative to one another, shearing off of a quantity of material is effected at each aperture or gap.

The material which is to be mixed, and which has passed radially through the apertures of the collars, is collected at the periphery of the ring bodies 1 and 2, and leaves the mixing chamber 11 through the outlet 14.

Figure 4:
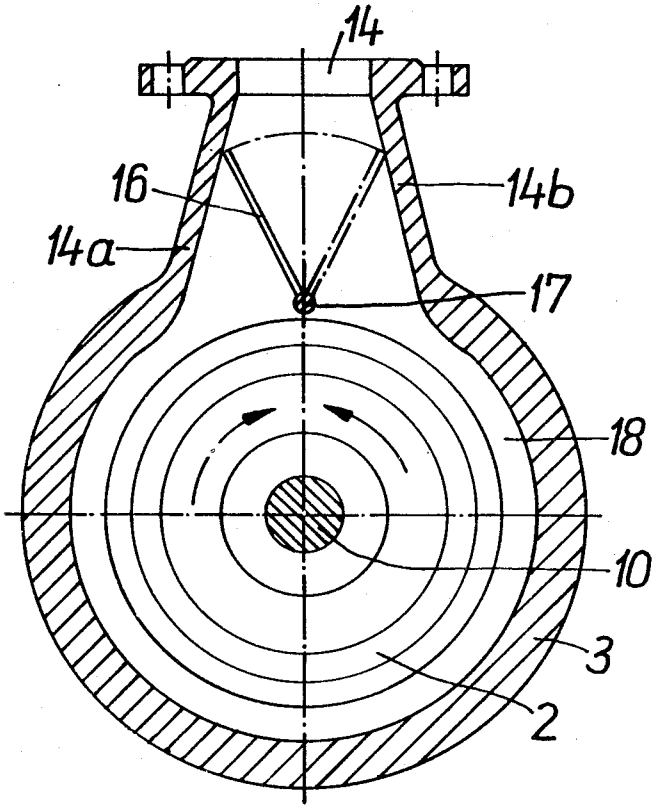
FIG. 4 is a cross-sectional view taken along line IV—IV in FIG. 3.

A baffle element is inserted into the free space 18 which surrounds the collars 4 to 9; this baffle element extends over the entire depth of the housing 3. Pursuant to the embodiment illustrated in FIGS. 1 and 2, the baffle element is designed as a wedge 15 and, when viewed in the direction of rotation of the rotor 2, is located after the outlet 14. In the embodiment illustrated in FIGS. 3 and 4, the baffle element is designed as a swinging flap 16, which is pivotably mounted on a shaft 17. Depending upon the direction of rotation of the rotor 2, the swinging flap 16 rests either against the wall 14*a* of the outlet 14, or, as shown in dot dash lines, against the wall 14*b*.

Figure 8:
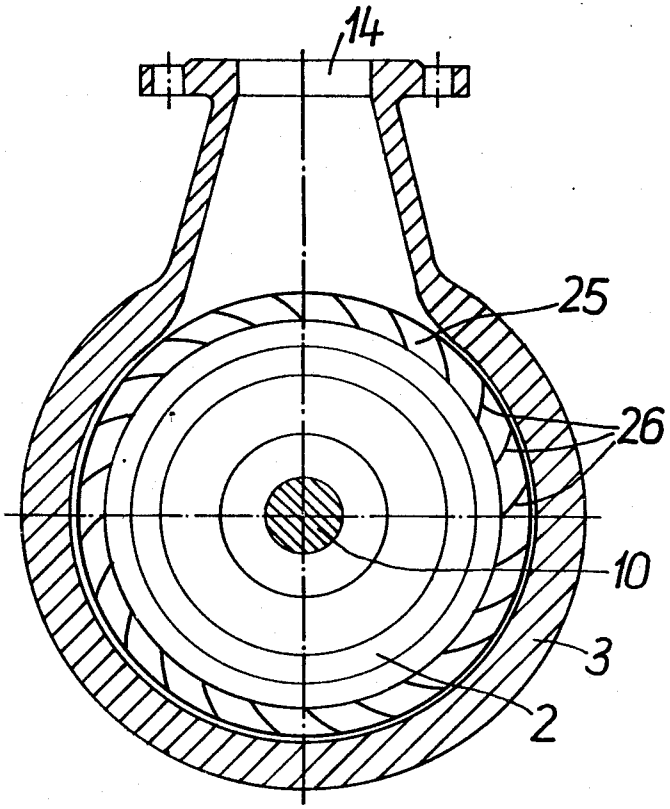
FIG. 8 is a cross-sectional view taken along line VIII—VIII in FIG. 7.
Figure 7:
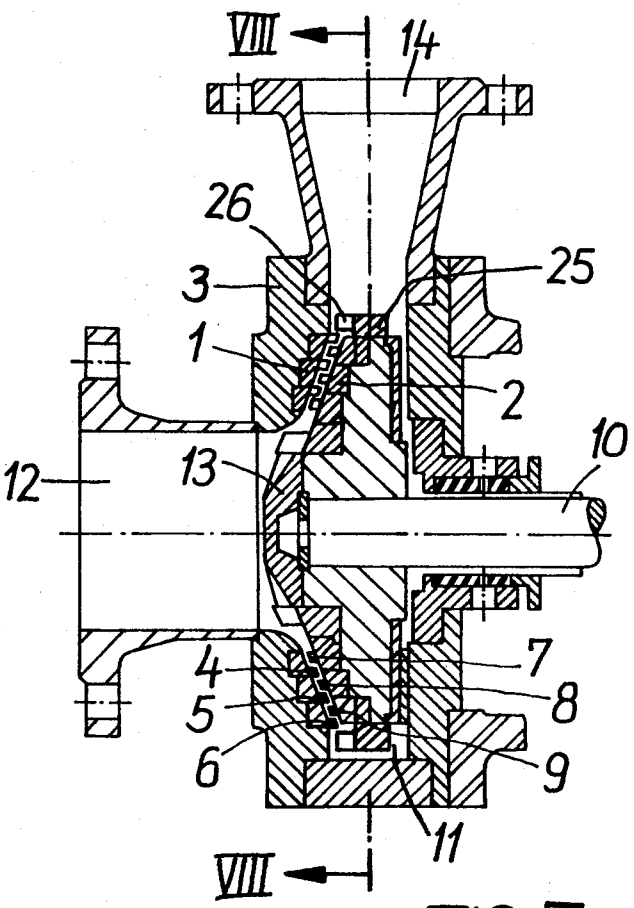
FIG. 7 is a cross-sectional view through another embodiment of the inventive homogenizer.

Pursuant to the embodiment illustrated in FIGS. 7 and 8, the support ring 25 is mounted on the outer periphery of the ring body 2; the ring 25 supports uniformly distributed vanes 26. The vanes 26 improve the conveying effect without adversely affecting the homogenization power, and produce the same effect as do the baffle elements 15 and 16.

Figure 5:
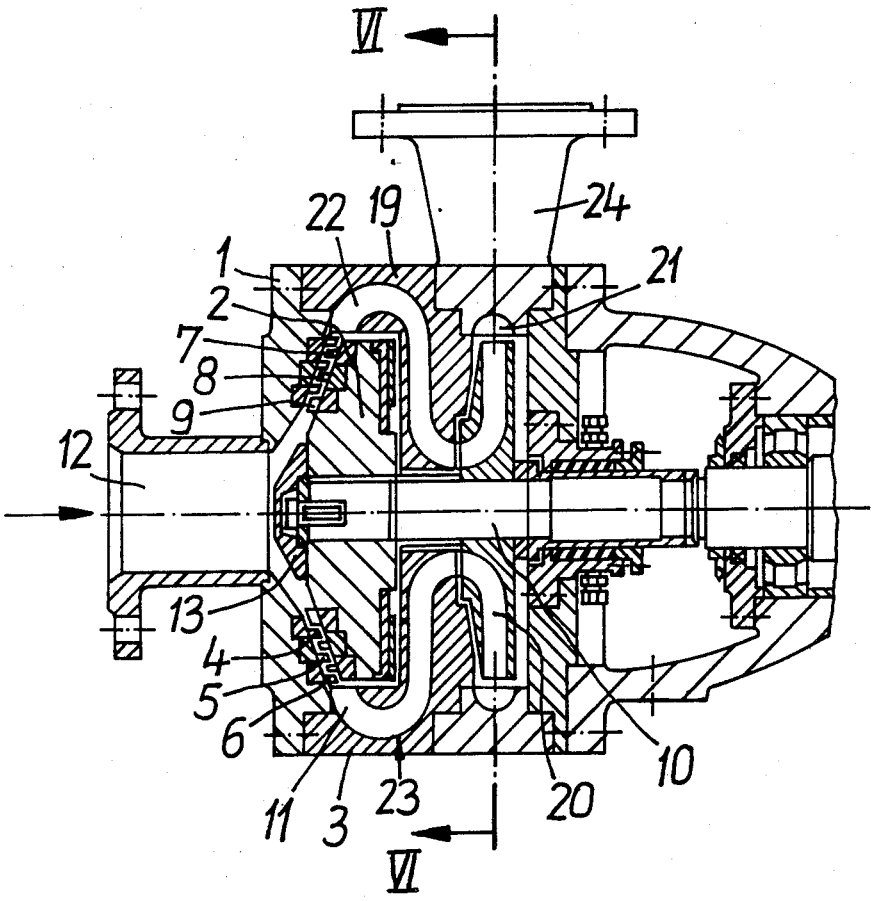
FIG. 5 is a cross-sectional view through a further embodiment of the inventive homogenizer.
Figure 6:
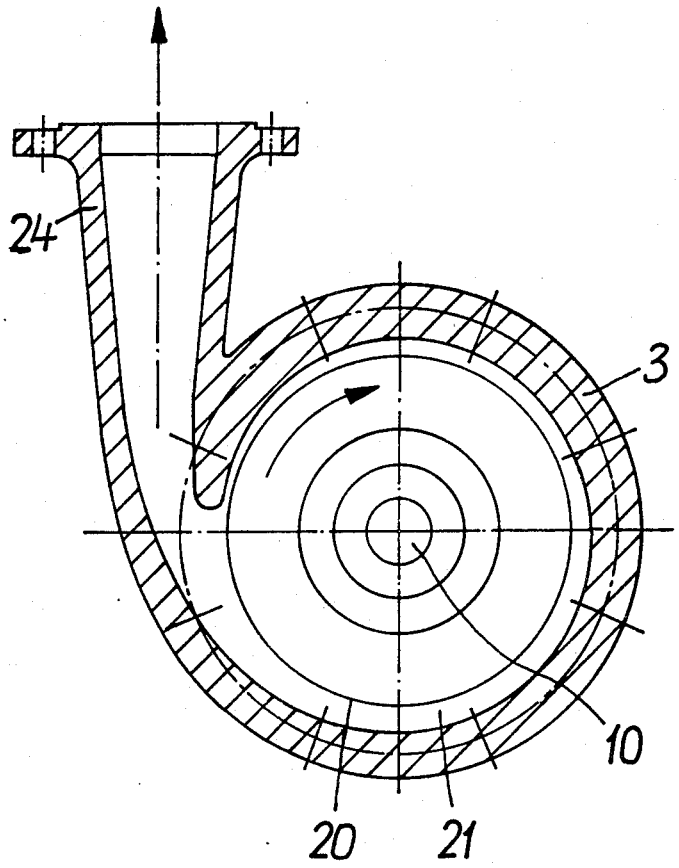
FIG. 6 is a cross-sectional view taken along line VI—VI in FIG. 5.

In the embodiment illustrated in FIGS. 5 and 6, the homogenizer has a second stage 19, in which in a pump chamber 21 there is provided a rotary pump rotor 20 which rotates along with the shaft 10.

The material which is to be mixed, and which has passed radially through the apertures of the collars 4, 5, and 6, is collected at the periphery of the ring bodies 1 and 2 and is conveyed via the mixing chamber 11 to a deflection chamber 22 within a deflection system 23, and from there to the rotary pump rotor 20. The chamber 21 is provided with a tangential outlet 24.

The pump rotor or impeller 20, with a pump chamber 21 which is designed in conformity to the requirements of a rotary pump, has the same effect as do the baffle elements 15 and 16, for the vanes 26.

The present invention is, of course, in no way restricted to the specific disclosure of the specification and drawings, but also encompasses any modifications within the scope of the appended claims.

What we claim is:

1. In an apparatus for producing emulsions or suspensions, and including a rotary homogenizer having a housing in which is disposed a rotary rotor; the end face of the rotor being provided with collars having apertures therein; these collars being arranged to rotate between other collars which are disposed in a similar manner on said housing; said housing having an axial inlet which, while leaving a gap, opens centrally against said end face of said rotor; said housing also having a radially disposed outlet;

the improvement in combination therewith which comprises means that form free cross-sectional areas in said collars of said rotor and said housing via said apertures of said collars, with said free cross-sectional areas being constant from collar to collar; an annular free space being provided surrounding said collars; and a baffle element additionally inserted in said free space and extending over the entire depth, i.e. the axial dimension, thereof, said combination attaining an increase in conveying capacity without any worsening of homogenizing effect of said rotary homogenizer.

2. An apparatus in combination according to claim 1, in which said baffle element is in the form of a wedge; when viewed in the direction of rotation of said rotor, said wedge being disposed after said outlet.

3. An apparatus in combination according to claim 1, in which said baffle element is a swinging flap, and is disposed within said outlet; in which said rotor has a drive axis; and in which said swinging flap has an axis of rotation which is located approximately in the center of said outlet, and extends parallel to said drive axis of said rotor and in the effective range of the latter.

4. An apparatus in combination according to claim 1, in which said baffle element is a vaned ring, and comprises a support ring rigidly connected to said rotor, and vanes mounted on said support ring.

5. In an apparatus for producing emulsions or suspensions, and including a rotary homogenizer having a housing in which is disposed a rotary rotor; the end face of the rotor being provided with collars having apertures therein; these collars being arranged to rotate between other collars which are disposed in a similar manner on said housing; said housing having an axial inlet which, while leaving a gap, opens centrally against said end face of said rotor; said housing also having a radially disposed outlet;

the improvement in combination therewith which comprises means that form free cross-sectional areas in said collars of said rotor and said housing via said apertures of said collars, with said free cross-sectional areas being constant from collar to collar; said apparatus having a shaft on which said rotor is mounted, and including two stages, namely a first stage adjacent said inlet, and a second stage which includes a rotary pump rotor mounted on said shaft; and a deflection system including a deflection chamber provided with a tangential outlet, said deflection system being provided in said housing between said first and second stages for supplying said emulsion or suspension from said first stage to said second stage; in the region of said rotary pump rotor, said housing being provided structurally in conformity to the requirements of a rotary pump, with said outlet being tangentially disposed relative to said housing, said combination attaining an increase in conveying capacity without any worsening of homogenizing effect of said rotary homogenizer.

6. An apparatus in combination according to claim 5, in which said deflection system comprises an annular channel which has 90° angular profile in the vicinity of said first stage, and which subsequent thereto, and up to entry into said rotary pump rotor, has an S-shaped profile.

* * * * *